US005644944A

United States Patent [19]

Dischler

[11] Patent Number: 5,644,944

[45] Date of Patent: Jul. 8, 1997

[54] PRESSING INSTRUMENT FOR PRESSING ON BUSHINGS, CABLE LUG PRESSES, OR SIMILAR ITEMS

[76] Inventor: Helmut Dischler, Dröste-Hülshoff-Str. 9, D-41464 Neuss, Germany

[21] Appl. No.: 570,190

[22] Filed: Dec. 11, 1995

Related U.S. Application Data

[63] Continuation of Ser. No. 391,088, Feb. 21, 1995, abandoned, which is a continuation of Ser. No. 174,051, Dec. 28, 1993, abandoned.

[30] Foreign Application Priority Data

Dec. 31, 1992 [DE] Germany ..... 92 17 886 U

[51] Int. Cl.[6] ..... H01R 43/048

[52] U.S. Cl. ..... 72/400; 72/399; 29/753

[58] Field of Search ..... 72/399–402, 410, 72/452, 421, 416; 29/751, 753, 237

[56] References Cited

U.S. PATENT DOCUMENTS

| | | | |
|---|---|---|---|
| 1,850,679 | 3/1932 | Leis | 72/400 |
| 2,541,544 | 2/1951 | Rahaim | 72/399 |
| 3,109,333 | 11/1963 | Anderson | 81/15 |
| 3,245,246 | 4/1966 | Filson | 72/400 |
| 3,575,036 | 4/1971 | Hoffman | 72/410 |
| 3,756,064 | 9/1973 | Erdmann | 72/410 |
| 4,048,839 | 9/1977 | Peterpaul | 29/753 |
| 4,304,116 | 12/1981 | Velarde | 72/399 |
| 4,604,890 | 8/1986 | Martin | 72/416 |
| 4,612,794 | 9/1986 | Schmidt | 72/421 |
| 4,732,434 | 3/1988 | Bush | 72/410 |

FOREIGN PATENT DOCUMENTS

| | | | |
|---|---|---|---|
| 137643 | 5/1934 | Austria | 72/399 |
| 308878 | 7/1973 | Austria . | |
| 1059525 | 6/1959 | Germany . | |
| 2316769 | 6/1976 | Germany . | |
| 2626919 | 12/1977 | Germany | 72/416 |
| 3235040 | 12/1984 | Germany . | |
| 8704860.4 | 4/1987 | Germany . | |
| 398264 | 2/1966 | Switzerland | 72/416 |
| 262599 | 7/1970 | U.S.S.R. | 72/399 |

*Primary Examiner*—Daniel C. Crane
*Attorney, Agent, or Firm*—Joseph W. Berenato, III

[57] ABSTRACT

A pressing instrument for pressing bushings, cable lugs, or similar items upon a work piece reveals two tools that can be brought together with the help of a drive mechanism, forming a pressing chamber, with each tool revealing two opposite pressing cheeks, whose pressing surfaces are shaped so that a polygonal shape will result during pressing. In order that work pieces of differing diameter can be processed with the pressing tool, that production costs can be kept comparatively low, and that good operational reliability can be achieved, opposite pressing cheeks (10, 11; 36, 37, 54, 55) of at least one tool (4, 34, 35) can be swung on them so that the other tool (5, 34, 35), as the tools are brought together (4, 5, 34, 35), will run against the swingable pressing cheeks (10, 11, 36, 37, 54, 55) and will swing them out of a starting position into a pressing position forming the pressing chamber.

22 Claims, 3 Drawing Sheets

FIG.1
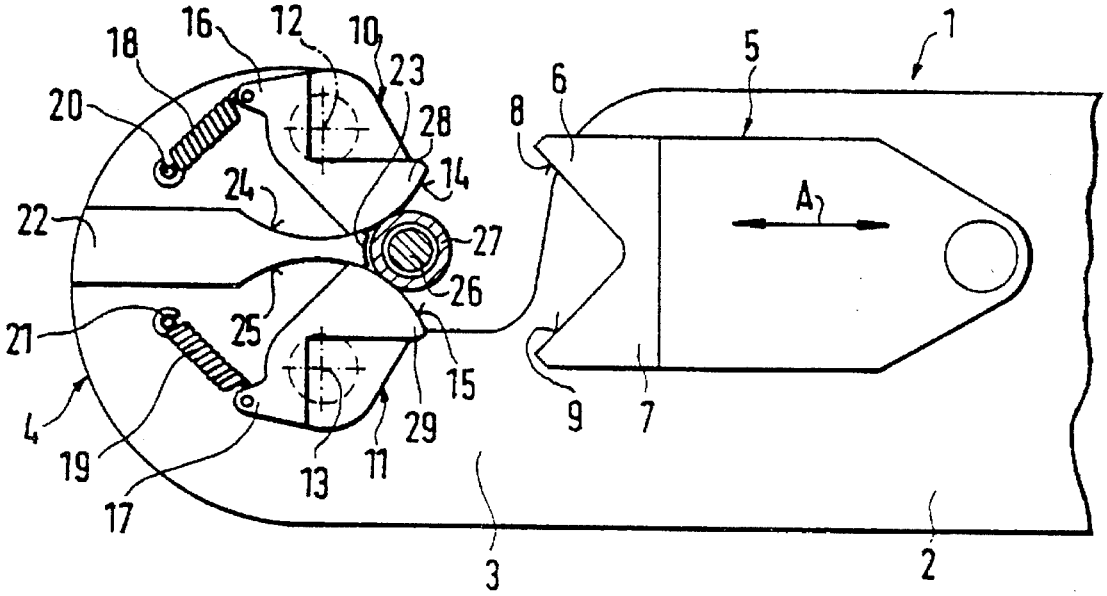
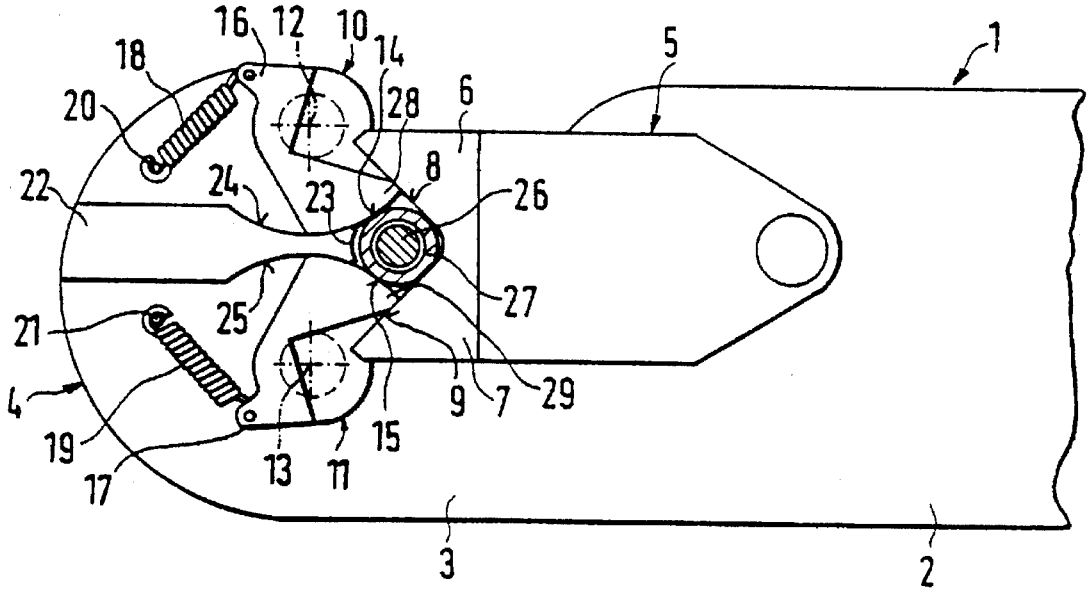
FIG.2

PRESSING INSTRUMENT FOR PRESSING ON BUSHINGS, CABLE LUG PRESSES, OR SIMILAR ITEMS

This is a continuation of application Ser. No. 08/391,088, filed on Feb. 21, 1995, now abandoned, which is a continuation of application Ser. No. 08/174,051 filed Dec. 28, 1993, now abandoned.

DESCRIPTION

This invention relates to a pressing instrument for pressing on bushings, cable lugs, etc., with two tools that can be combined with the help of a drive device, forming a pressing chamber, with each tool revealing two opposite pressing cheeks, whose pressing surfaces are so shaped that a polygonal shape will result during pressing.

Cable lug pressing instruments are used particularly in connection with high-voltage wiring installation work. Here, a cable lug is set upon the end of a conductor and is then connected with the conductor in that the cable lug is pressed radially. In this way, the cable lug and, partly, also the conductor on it are deformed so that a firm press connection results.

A cable lug pressing instrument, for example, can be found in DE-PS 32 35 040. Such pressing instruments basically consist of two tools, that is, an upper tool and a lower tool, as well as a drive device, e.g. a hydraulic cylinder, with whose help one of the tools can be shifted in the direction toward the other tool, until both tools have been brought together, forming a pressing chamber.

The tools themselves reveal pressing cheeks whose pressing surfaces are shaped so that one can achieve a desired deformation of the bushing, of the cable lug, etc. and, if necessary, so that one can also get work pieces even when the tools are brought together. In the routine case, one seeks to achieve a polygonal shape, including deformation to constitute a regular polygon, especially a hexagon.

In the pressing instrument according to DE-PS 32 35 040, it is necessary to exchange at least the pressing cheeks when bushings or similar items must be pressed on work pieces with differing diameter. This is rather laborious and presupposes the availability of accordingly dimensioned pressing cheeks. A pressing instrument, improved to that extent, has therefore been developed and it is disclosed in DE-GM 87 04 860.4. This pressing instrument has mutually engaging pressing cheeks that simultaneously form sliding surfaces for neighboring tool parts. Using this pressing instrument, one can provide work pieces of differing diameter with bushings or similar items within a broad range, without having to exchange parts of the pressing instrument to do that.

One disadvantage of this pressing instrument is represented by the fact that it requires expensive manufacturing on because of the required accuracy in processing the individual sliding surfaces and that, even then, flawless operation cannot be guaranteed because of the developing surface pressure. This is why this particular pressing instrument was not used in practice.

The purpose of the invention is to design a pressing instrument of the kind mentioned initially by which one can process work pieces of different diameter, within a useable range, but by which, on the other hand, the production costs will be comparatively low and that good operational reliability will be attained.

This problem is solved according to the invention in that opposite pressing cheeks of at least one tool are positioned on it in a swingable fashion so that the other tool, as the tools are brought together, will run into the swingable pressing cheeks and swing them out of an initial position into a pressing position, which constitute the pressing chamber.

According to the invention, there is provided, on each tool, at least one pair of pressing cheeks that can be swung toward each other and against which the other tool runs as the tools are brought together, in order to swing them out of an initial position toward a pressing position. It has been found that, even by providing swingable pressing cheeks on only one tool, one can press work pieces of differing diameter, using the pressing instrument within a relatively broad range, without having to exchange the pressing cheeks to do that. Here it is advantageous for the other tool to reveal opposite, swingable pressing cheeks.

By controlling the movement of the swingable pressing cheeks accordingly, one can furthermore achieve an essentially more uniform side length ratio. Furthermore, the inclination of the work piece, in terms of twisting during the pressing action, which is found in known pressing instruments, can thus be avoided.

To be sure, the state of the art includes presses with two tools that can be brought together via a drive device, where each tool reveals two opposite pressing cheeks which are positioned so that they can swing and which come to rest against each other as they are moved together, along with reciprocal swinging action. The pressing cheeks are positioned and the pressing surfaces are designed, however, so that one gets an essentially round pressing chamber. Accordingly, this press can also be used to press circular work pieces having a certain diameter, retaining the basic shape of this cross-section; this is the exact opposite of the objective behind the invention at hand.

In the simplest case, the swingable pressing cheeks are positioned via swivel pins so that they perform a pure swinging motion. But it is also possible to direct the swingable pressing cheeks so that they will adjoin suitable guide tracks in order to superpose the swinging motion with another motion, for example, a translation motion.

As a further feature of the invention, it is provided, as the tools are moved together, that the pressing cheeks run into each other, in other words, direct contact is established between the pressing cheeks.

The invention furthermore provides that the swingable pressing cheeks be spring-impacted in the direction toward the initial position, so that one can guarantee that the pressing cheeks will also in fact swing from a certain starting position when the tools are moved together.

It is furthermore proposed that, between the swingable pressing cheeks of a tool, an additional pressing cheek, motionless with respect to the former pressing cheeks, be arranged. Such an arrangement is advantageous especially when one wishes to achieve an essentially regular hexagonal cross-section of the pressing chamber. The swingable pressing cheeks and the pressing cheek that is motionless with respect to them and that belongs to a pressing tool should be adapted to each other so that the swingable pressing cheeks will guide the pertinent motionless pressing cheek over the swing range. This can be achieved by shaping the pressing cheeks accordingly.

The swingable pressing cheeks can reveal level, but also convex pressing surfaces, in order to achieve a desired final cross-section.

The drawing illustrates the invention in greater detail, with the help of practical examples.

FIG. 1 is a pressing instrument according to the invention in the initial position;

FIG. 2 shows the pressing instrument according to FIG. 1 at the start of the pressing process;

Figure 3:
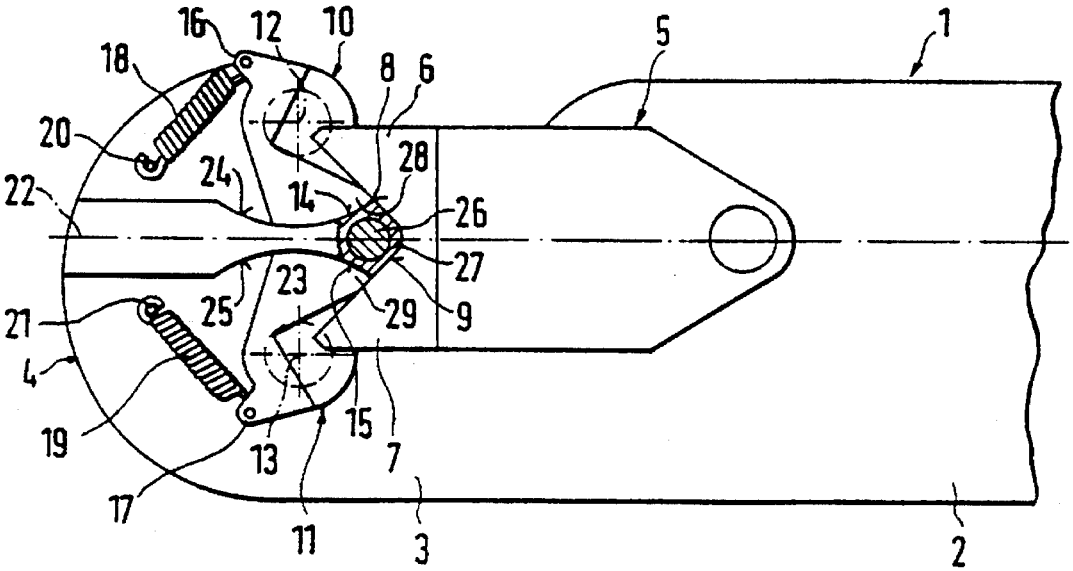
FIG. 3 shows the pressing instrument according to FIGS. 1 and 2 at the end of the pressing process.

Pressing instrument (1), illustrated schematically in FIGS. 1 to 3, has an instrument frame (2) that is continued in an underside bar (3) and a rounded uppertool (4). On the instrument frame (2), an undertool (5) is guided so that it can be moved by way of translation in the directions indicated by double arrow A. The undertool (5) is connected with a drive device (not shown here in greater detail). Such a drive device is usually made in the form of a hydraulic cylinder arrangement, with whose help the undertool (5) can be shifted.

The undertool (5) has two connected, opposite pressing cheeks (6, 7) that are firmly connected with the undertool (5) and whose pressing surfaces (8, 9) are V-shaped with respect to each other. On the uppertool (4), two opposite pressing cheeks (10, 11) are positioned so that they can swing around pins (12, 13). Pressing cheeks (10, 11) have convex-shaped pressing surfaces (14, 15). Pins (12, 13) extend perpendicularly to the plane of the drawing. Pressing cheeks (10, 11) reveal projections (16, 17), at which traction springs (18, 19) attack and, at the other end, which are attached to pegs (20, 21) that are connected with the uppertool (4).

Attached to the uppertool (4) is another pressing cheek (22) that extends with a tapering part between swingable pressing cheeks (10, 11) and that reveals a concave pressing surface (23). The pressing cheek (22) furthermore has concave guide surfaces (24, 25) on which glide the pressing surfaces (14, 15) of the pressing cheeks (10, 11) whenever pressing cheeks (10, 11) are swung out of their initial position, as shown in FIG. 1, into the pressing position according to FIG. 3.

For a pressing process, one inserts in the opened pressing instrument (1), as illustrated in FIG. 1, a conductor (26) with superposed, bushing-shaped cable lug (27), between pressing cheeks (10, 11) of the uppertool (4). Then the undertool is moved with the help of the drive device in the direction of the uppertool (4). Even before pressing cheeks (6, 7) of the undertool (5) come to rest against the cable lug (27), their pressing surfaces (8, 9) bump into the projections (28, 29) of pressing cheeks (10, 11). As the undertool (5) is gradually moved further on, projections (28, 29) slide inward on pressing surfaces (8, 9) of pressing cheeks (6, 7); as a result, pressing cheeks (10, 11) of the uppertool (4) are swung against each other. At the same time, pressing cheeks (10, 11) glide on guide surfaces (24, 25). Both of these can be seen by comparing FIG. 1 and FIG. 2; here, the undertool (5), in the illustration according to FIG. 2, has in the meantime run into the combination of conductor (26) and cable lug (27).

The further movement of the undertool (5) with respect to the uppertool (4) then leads to a deformation of the cable lug (27) and of the conductor (26), while the pressing cheeks (10, 11) of the uppertool (4) are swung further. In the process, the combination consisting of conductor (26) and cable lug (27) is also pressed against the additional pressing cheek (22). One then gets the cross-section resulting from FIG. 3 that is approximately a hexagon. After the return of the undertool (5), the unit, which consists of conductor (26) and cable lug (27), can be removed once it has been pressed.

Figure 4:
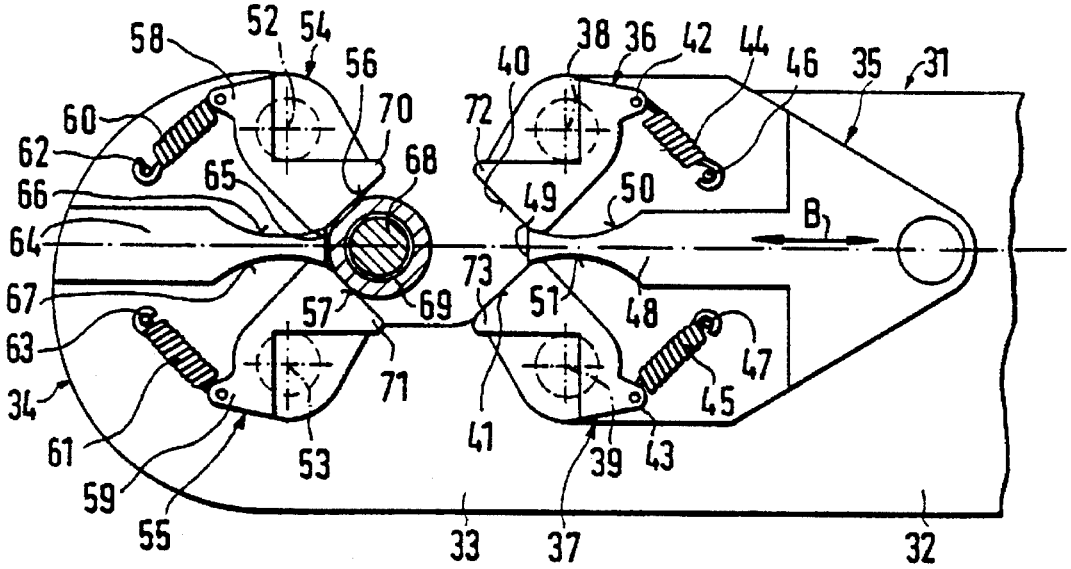
FIG. 4 is another pressing instrument according to the invention in the starting position.
Figure 5:
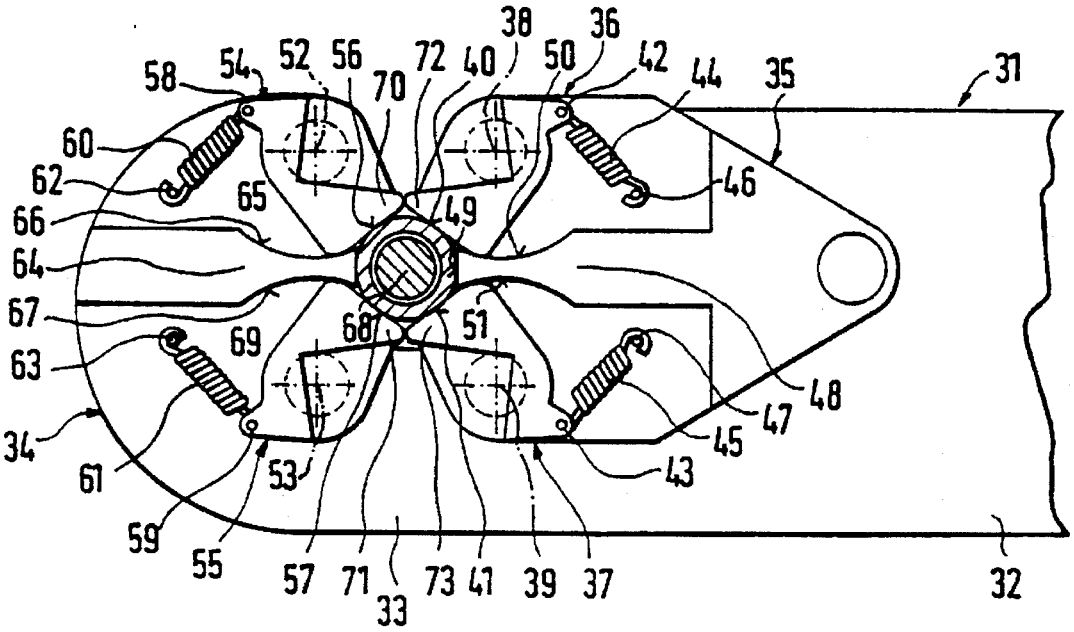
FIG. 5 shows the pressing instrument according to FIG. 4 at the start of the pressing procedure.
Figure 6:
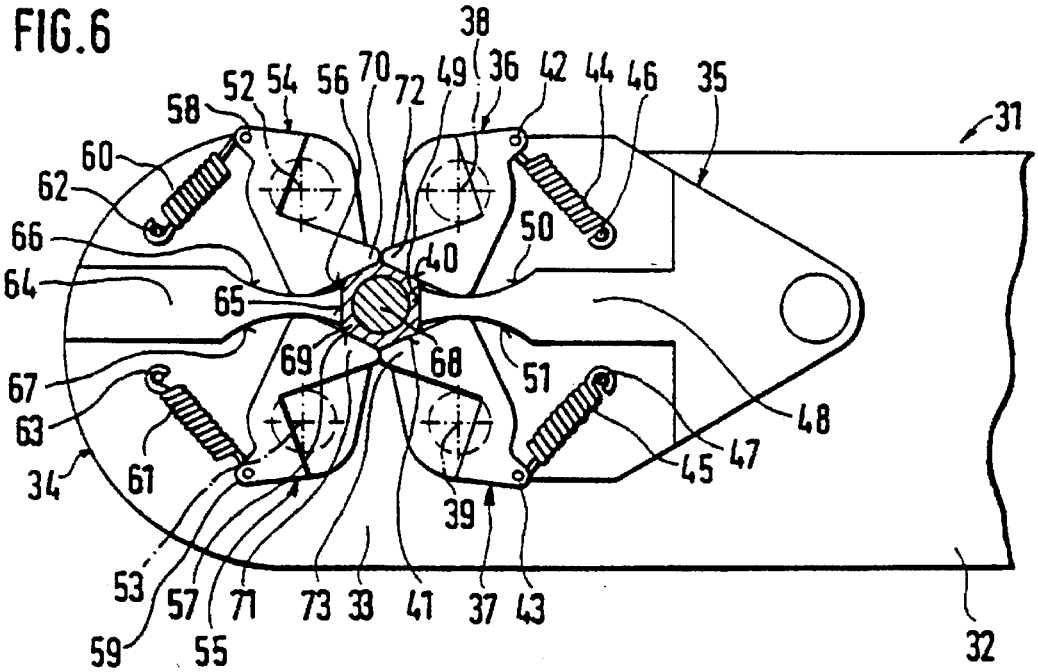
FIG. 6 shows the pressing instrument according to FIGS. 4 and 5 at the end of the pressing process.

The pressing instrument (31), shown in FIGS. 4 to 6, has an instrument frame (32) that continues in an underside bar (33) and a rounded uppertool (34). On the instrument frame (2), here again, an undertool (35) is moved by way of translation in the directions of double arrow B. The undertool likewise is likewise connected with a drive device (not shown in any greater detail), for example, in the shape of a hydraulic cylinder arrangement or an electric motor.

The undertool (35) has two opposite pressing cheeks (36, 37) which, in contrast to the practical example according to FIGS. 1 to 3, are positioned so that they can swing around pins (38, 39). Pressing cheeks (36, 37) have level pressing surfaces (40, 41). They reveal projections (42, 43) at which traction springs (44, 45) attack; at the other end, these traction springs are attached to pegs (46, 47) that are connected with the undertool (35).

Attached to the undertool (35) is another pressing cheek (48) that extends with a tapering part between swingable pressing cheeks (40, 41) and that likewise reveals a level pressing surface (49). The additional pressing cheek (48) has concave guide surfaces (50, 51) on which segments of pressing cheeks (36, 37) that adjoin pressing surfaces (40, 41) glide past whenever pressing cheeks (36, 37) are swung out of their initial position, shown in FIG. 4, into the pressing position according to FIG. 6.

The uppertool (34) is essentially identical to the uppertool (4) of the practical example according to FIGS. 1 to 3 and, moreover, is made laterally-reversed with respect to the undertool (35). Accordingly, it has pressing cheeks (54, 55) that are positioned so that they can swing around pins (52, 53) and that have level pressing surfaces (56, 57). Traction springs (60, 61) attack projections (58, 59); these traction springs are connected with the uppertool (34) via pegs (62, 63).

Here again, an additional pressing cheek (64), with a level pressing surface (65), extends between pressing cheeks (54, 55). It has concave guide surfaces (66, 67) on which pressing cheeks (56, 57) slide.

The pressing process essentially takes place as in the case of the practical example according to FIGS. 1 to 3. A combination consisting of conductor (68) and bushing-shaped cable lug (69) is inserted in the opened pressing instrument (31). The undertool (35) is moved toward the uppertool (34) by means of the drive mechanism. Whenever pressing surfaces (40, 41) or (56, 57) of pressing cheeks (36, 37) or (54, 55) come to rest against the cable lug (69), then projections (70, 71, 72, 73) on pressing cheeks (36, 37, 54, 55) will bump into each other. The actual pressing process begins at that moment.

As the undertool (35) is gradually moved further in the direction of the uppertool (34), pressing cheeks (36, 37) of the undertool (35) and pressing cheeks (54, 55) of the uppertool (34) are swung and thus slide on guide surfaces (50, 51) or (66, 67). This leads to a deformation of the cable lug (69) and of the conductor (68); this combination can then also be pressed against the additional pressing cheeks (48, 64). In this way, one gets the hexagonal cross-section that can be seen in FIG. 6.

After the return of the undertool (35), the unit, which consists of conductor (68) and cable (69), can be removed once it has been pressed. Here, the pressing cheeks (36, 37) or (54, 55), due to the action of the traction springs (44, 45) or (60, 61), again swing back into the initial position shown in FIG. 4.

I claim:

1. Press device for pressing deformable elements onto a workpiece, comprising:

a) first and second tools between which there is a press area in which a workpiece is to be positioned;

b) one of said tools is reciprocally movable relative to the other of said tools;

c) said first tool includes a first pair of press cheeks pivotal between an open position and a final press position, each press cheek having a press surface, and said first pair of press surfaces converge and open toward the press area for engagement with the workpiece;

d) said second tool includes a second pair of press cheeks opposed diametrically to said first pair of press cheeks, each cheek of said second pair having a press surface, and said second pair of press surfaces converge and open toward the press area for engagement with the workpiece; and e) a stationary cheek plate having a press surface, said cheek plate secured to said first tool and disposed between and cooperating with said first pair of press surfaces so that when said one tool approaches said other tool said first and second pair of press cheeks initially engage each other and thereafter said first pair of press cheeks pivot from said open position to said final press position while maintaining said first pair of press surfaces in convergence and reducing the size of the press area so that the converging surfaces impart to the deformable element a configuration corresponding to the configuration of the converging press surfaces.

2. The press device of claim 1, wherein:

a) said second pair of press cheeks are pivotal between an open position and a press position.

3. The press device of claim 2, wherein:

a) a second stationary cheek plate having a press surface is secured to said second tool, said second cheek plate is disposed between and cooperates with said second pair of press surfaces.

4. The press device of claim 2, wherein:

a) means are operably associated with each of said press cheeks of said first and second tools for biasing the press cheeks into the open position.

5. The press device of claim 4, wherein:

a) said bias means includes a spring.

6. The press device of claim 4, wherein:

a) each of said press cheeks includes a projection remote from the associated press surface, and said biasing means are connected to each of said projections.

7. The press device of claim 2, wherein:

a) each of said tools includes a pair of guide surfaces, each guide surface associated with an adjacent press cheek for guiding the associated cheek during pivoting between said open and press positions.

8. The press device of claim 7, wherein:

a) each guide surface is concave.

9. The press device of claim 7, wherein:

a) the guide surfaces of said first tool are integral with said stationary cheek plate.

10. The press device of claim 3, wherein:

a) each of said tools includes a pair of concave guide surfaces, each guide surface is associated with an adjacent press cheek for guiding the associated cheek during pivoting.

11. The press device of claim 10, wherein:

a) said guide surfaces are integral with the associated cheek plate.

12. The press device of claim 1, wherein:

a) said first pair of press surfaces are each arcuate in contour.

13. The press device of claim 12, wherein:

a) said cheek plate press surface is arcuate.

14. The press device of claim 13, wherein:

a) said second pair of press cheeks are integral.

15. The press device of claim 1, wherein:

a) each press surface of said first and second pair of press cheeks is level.

16. The press device of claim 3, wherein:

a) each press surface of said first and second pair or press cheeks and of said first and second cheek plates is level.

17. The press device of claim 3, wherein:

a) said first and second cheek plates extend longitudinally along the associated tools.

18. The press device of claim 17, wherein:

a) the press cheeks of each tool are disposed on opposite sides of the associated cheek plate.

19. The press device of claim 1, wherein:

a) means bias each cheek plate of said first pair into said open position; and b) the cheek plates of said second pair are integral and non-pivotal.

20. The press device of claim 1, wherein:

a) said one tool is said second tool.

21. A tool assembly for pressing deformable elements onto a workpiece, comprising:

a) a frame having an opening intermediate opposite first and second end portions thereof;

b) an undertool mounted to said frame proximate said second end portion, said undertool reciprocally slidable relative to said opening between a position obstructing said opening and a position exposing said opening and said undertool having first and second converging pressing surfaces adapted for, when said undertool is in said obstructing position, engaging and pressing a deformable element positioned about a workpiece positioned within said opening;

c) first and second adjacently disposed pressing cheeks mounted to said frame proximate said first end portion and pivotal between a first and final second position, each pressing cheek having a pressing surface positioned within said opening when the pressing cheek is in said first pivoted position for engaging and pressing a deformable element mounted about a workpiece positioned within said opening and said undertool is in said obstructing position and said pressing cheek press surfaces converging; and d) first and second arcuate guide surfaces secured to said frame proximate said first end portion, each guide surface juxtaposed to and cooperating with the pressing surface of an associated pressing cheek so that said pressing cheeks are guided therealong while being pivoted between said first and final second positions so that the converging surfaces impart to the deformable element a configuration corresponding to the configuration of the converging surfaces.

22. The press device of claim 1, wherein:

a) said second tool press cheeks converge into a V-shape.

* * * * *